US008579259B2

(12) United States Patent
Okerlund et al.

(10) Patent No.: US 8,579,259 B2
(45) Date of Patent: Nov. 12, 2013

(54) TWO SPEED WINCH ASSEMBLY

(75) Inventors: Kawa-She-Quoen Okerlund, Wittenberg, WI (US); Eric Anderson, Plover, WI (US); Todd Walstrom, Weston, WI (US); Joseph J. Peschmann, Plover, WI (US)

(73) Assignee: Cequent Performance Products, Inc., Plymouth, MI (US)

( * ) Notice: Subject to any disclaimer, the term of this patent is extended or adjusted under 35 U.S.C. 154(b) by 713 days.

(21) Appl. No.: 12/778,008

(22) Filed: May 11, 2010

(65) Prior Publication Data

US 2011/0278521 A1 Nov. 17, 2011

(51) Int. Cl.
*B66D 1/22* (2006.01)
*B66D 1/14* (2006.01)

(52) U.S. Cl.
USPC ..... 254/345; 254/344; 254/352; 254/356

(58) Field of Classification Search
USPC ..... 254/344, 345, 352, 346, 356
IPC ..... B66D 1/04,1/06
See application file for complete search history.

(56) References Cited

U.S. PATENT DOCUMENTS

| | | | | |
|---|---|---|---|---|
| 1,936,642 | A * | 11/1933 | Ramsey | 254/344 |
| 3,047,114 | A * | 7/1962 | Stevens, Jr. | 192/16 |
| 3,159,368 | A * | 12/1964 | Ahlbin et al. | 248/222.41 |
| 3,326,398 | A | 6/1967 | Reed | |
| 3,785,677 | A | 1/1974 | Calkins | |
| 4,463,965 | A | 8/1984 | Lawson | |
| 4,582,298 | A * | 4/1986 | Boome et al. | 254/266 |
| 4,687,219 | A | 8/1987 | Rendzio | |
| 4,802,685 | A | 2/1989 | Godbersen | |
| 4,820,111 | A | 4/1989 | Godbersen | |
| 4,986,571 | A | 1/1991 | Godbersen | |
| 5,064,336 | A | 11/1991 | Godbersen | |
| 5,076,603 | A | 12/1991 | Godbersen | |
| 5,273,391 | A | 12/1993 | White | |
| 5,417,447 | A | 5/1995 | Godbersen | |
| 6,431,525 | B1 | 8/2002 | Roll | |
| 6,916,267 | B2 * | 7/2005 | Jones et al. | 475/299 |
| 7,000,904 | B2 * | 2/2006 | Huang | 254/323 |
| 7,125,032 | B2 | 10/2006 | Hopper | |
| 7,219,914 | B2 | 5/2007 | Huddleston | |
| 7,237,788 | B1 | 7/2007 | Norbits | |
| 7,789,375 | B2 * | 9/2010 | Ying | 254/344 |
| 2010/0148139 | A1 | 6/2010 | Anderson et al. | |

FOREIGN PATENT DOCUMENTS

EP 744374 A2 * 11/1996

* cited by examiner

*Primary Examiner* — Emmanuel M Marcelo
*Assistant Examiner* — Justin Stefanon
(74) *Attorney, Agent, or Firm* — McDonald Hopkins LLC

(57) ABSTRACT

Apparatus for a two speed winch assembly are described herein. The winch assembly may be secured to a towing trailer and is arranged to assist in loading and unloading cargo from the trailer. The winch assembly may include mechanisms, systems, and features to make the winch assembly easy to assemble and use, increase the service life of the winch assembly, and improve the consistency of the performance of the winch assembly.

20 Claims, 15 Drawing Sheets

TWO SPEED WINCH ASSEMBLY

FIELD OF INVENTION

The present invention relates generally to winch assemblies, and more particularly, to winch assemblies for towing trailers having improved functionality and ease of use.

BACKGROUND

Towing vehicles or trailers are designed to secure and haul cargo. Trailers may be arranged to haul various types of cargo, such as boats, automobiles, consumer products, and the like. Many such cargo items may be large, heavy and difficult to move or maneuver onto the bed or frame of a towing trailer. To assist in moving or maneuvering the cargo onto the towing trailer, such trailers may often be equipped with a winch or winch assembly.

The winch assembly may commonly be attached to a tongue of the trailer. The winch may be connected to a cargo item by, for example, a strap, cable, rope, chain or the like that may aid in pulling the cargo item onto the trailer. The winch assembly may typically utilize a handle to rotate a drum to wind the strap or cable around the drum thereby pulling the cargo item towards the winch. The winch assembly may also be utilized to unload heavy items from the trailer by rotating the drum in the opposite direction thereby unwinding the strap or chain to allow the cargo item to be slid off of the trailer.

SUMMARY

Apparatus for a two speed winch assembly are described herein. The winch assembly may be secured to a towing trailer and is arranged to assist in loading and unloading cargo from the trailer. The winch assembly may include mechanisms, systems, and features to make the winch assembly easy to assemble and use, increase the service life of the winch assembly, and improve the consistency of the performance of the winch assembly.

BRIEF DESCRIPTION OF THE DRAWINGS

Objects and advantages together with the operation of the invention may be better understood by reference to the detailed description taken in connection with the following illustrations, wherein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

A two speed winch assembly 10 is illustrated in FIGS. 1, 6, 7, 9-12C and 16-18. The two speed winch assembly 10 may provide improved aesthetics and performance to towing vehicles, such as marine trailers. When the winch assembly 10 is properly mounted to a boat trailer (not shown), the winch assembly 10 may be utilized to assist in the loading and final positioning of the boat onto the trailer. This type of situation may commonly occur while using a boat trailer to remove a boat from a body of water.

Figure 6:
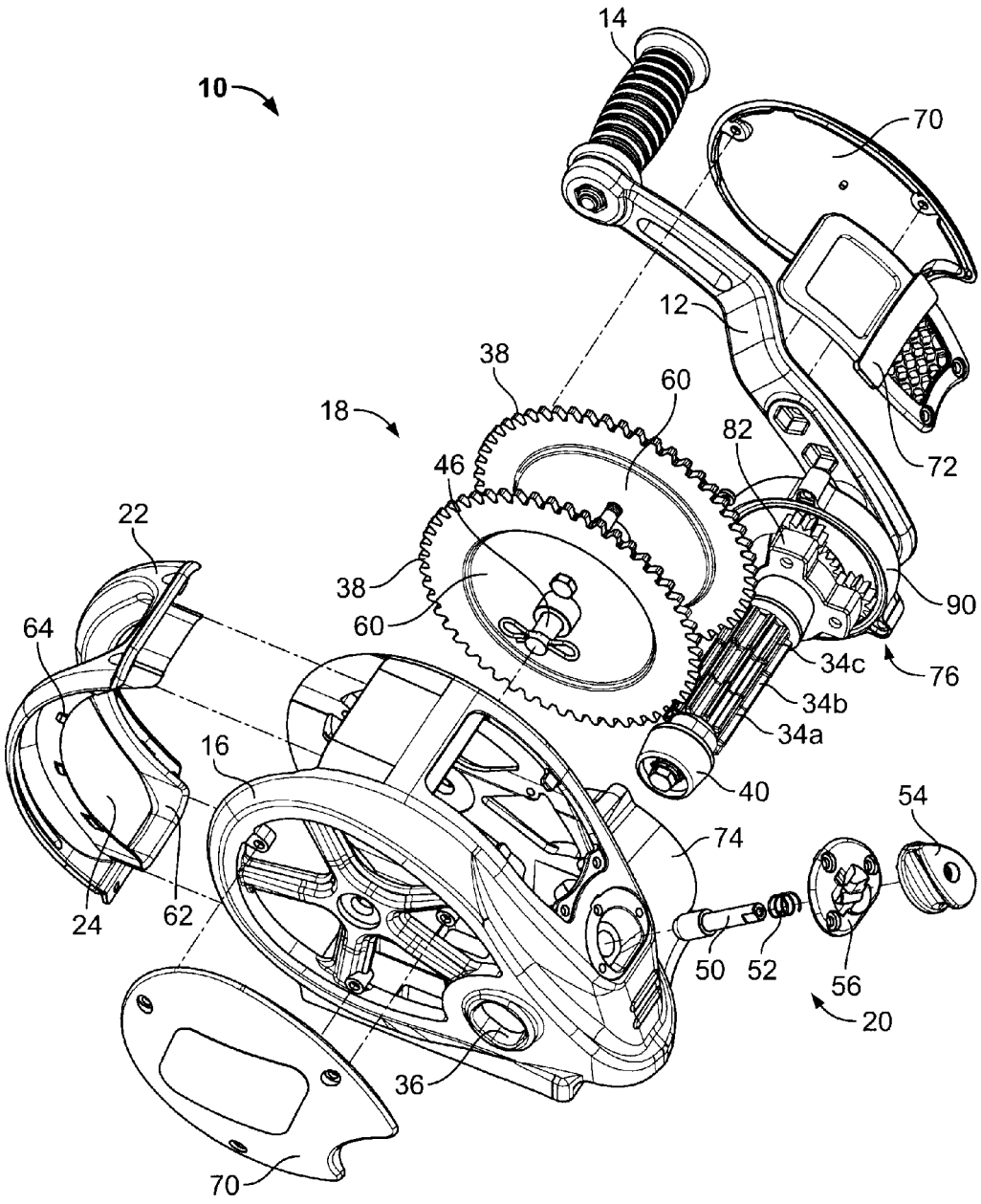
FIG. 6 illustrates a partial exploded view of a two speed winch assembly.
Figure 8:
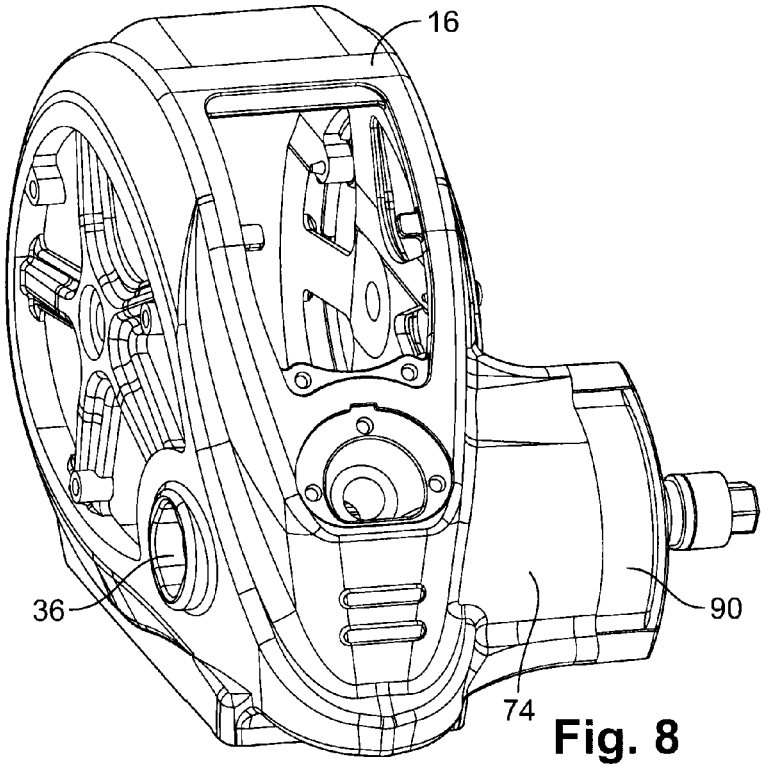
FIG. 8 illustrates a perspective view of a frame for a two speed winch assembly.
Figure 9:
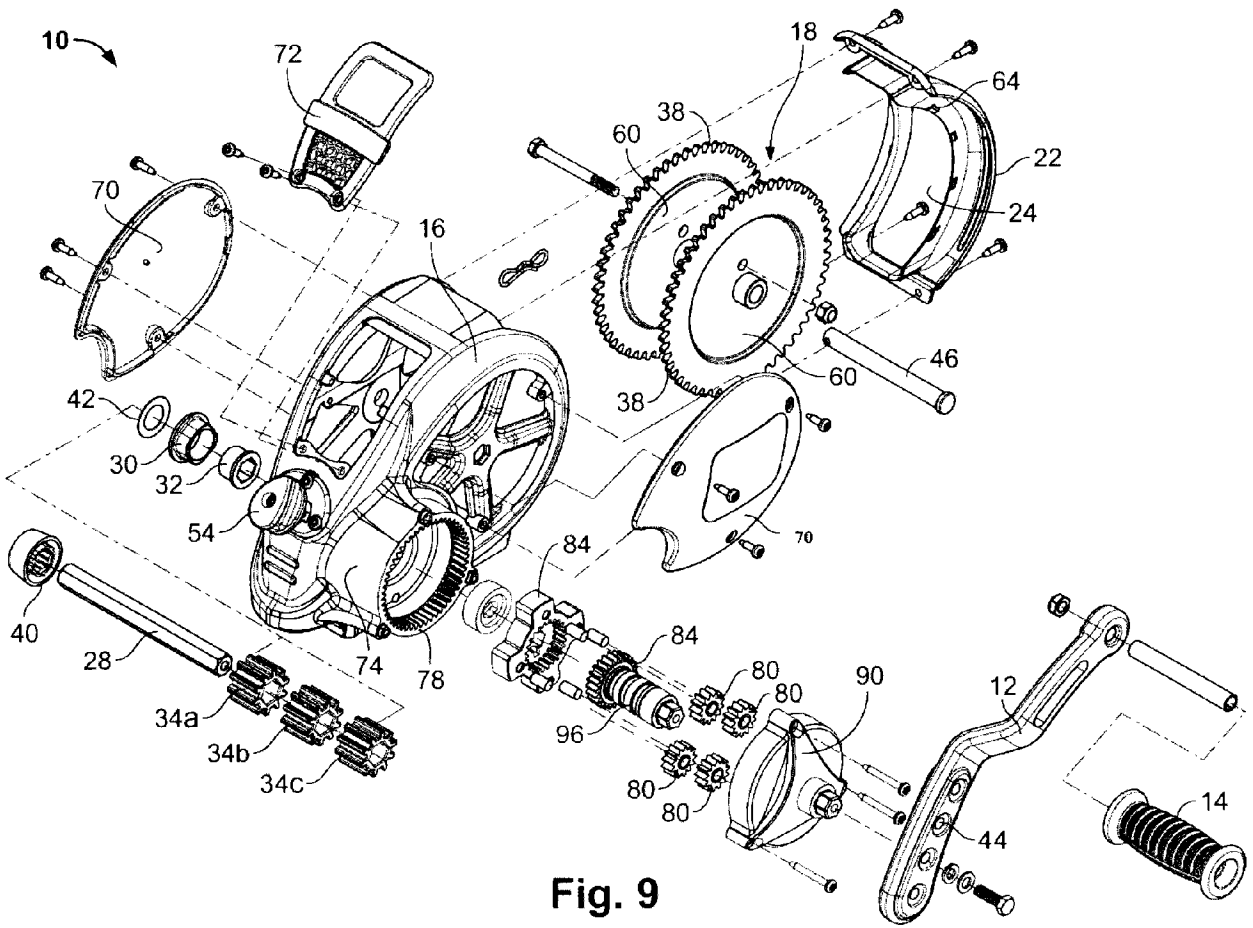
FIG. 9 illustrates an exploded view of a two speed winch assembly.

The winch assembly 10 may include a handle or crank 12, a winch housing or frame 16 that may house the internal components of the winch assembly 10, such as a two speed gearbox 76, and a base plate 26 (FIGS. 6 and 9). The base plate 26 may be configured to facilitate the securing or attaching of the winch assembly 10 to a winch stand (not shown) or directly to a towing trailer. The handle 12 may include a grip 14 (FIGS. 1-3, 6-9, 11-12C and 15). The grip 14 may be of any appropriate shape or size and be located at any appropriate position on the handle 12. For example, the grip 14 may be secured to an end of the handle 12 to facilitate the manual rotation of the handle 12.

Most trailer winches are manufactured from a formed steel stamping. This material and process may severely limit the features and aesthetics that can be incorporated into the design. The winch frame 16 may be fabricated as a one-piece, die-cast aluminum component (FIGS. 6 and 8). The use of high pressure die casting may allow for complex and aesthetic shapes, incorporate many desirable features, provide for a high strength construction, and may make manufacturing easier. Die casting allows for precision control of dimensions of the frame 16, and allows for forming thicker sections to strengthen the frame 16. Covers 70, 72 may be attached with the winch frame 16 to provide an aesthetically pleasing finish to the winch assembly 10. Covers 70 may be attached with the side portions of the winch frame 16 in any appropriate manner, such as shown in FIG. 6. Covers 70 may generally hide certain portions of the winch frame 16 from view. Further, the cover 72 may be attached with the frame 16 in any appropriate manner. The cover 72 may include a portion for inclusion of a product identification or branding.

The winch assembly 10 may also include a winch drum 18 and a ratchet and pawl system 20 (FIGS. 2-6 and 9). The winch drum 18 and ratchet and pawl system 20 may be located within the winch frame 16 for selectively driving and locking the winch drum 18. The winch assembly 10 may be arranged to load and unload cargo onto a towing trailer by securing a strap (not show) to the cargo.

The strap may be attached to the drum 18 to pull cargo onto the trailer when the drum 18 is rotated in a first direction and allow cargo to slide off the trailer when the drum 18 is rotated in a second and opposite direction. The drum 18 may be located within the frame 16 and positioned on a shaft 46, such as a pin (FIGS. 2-6 and 9).

The winch assembly 10 drive system may drive the drum 18 to load and unload cargo. The winch assembly 10 drive system may be an adjustable floating winch system that may be driven by a hand operated adjustable crank handle 12. The drive system may include a drive shaft 28, an outer bearing 30, an inner bearing 32, and three drive gears 34*a*, 34*b*, 34*c* (FIG. 9).

The outer and inner bearings 30, 32 may be slip bearings and may be positioned to hold the drive shaft 28 on one end (FIG. 9). The bearings 30, 32 may be slip bushings that hold the drive shaft assembly in place on one end. The drive shaft 28 may be hexagonal in cross-sectional shape. The three drive gears 34 may be slip fit onto the hexagonal drive shaft 28, and each drive gear 34 operates independent of the other two drive gears 34.

The outer bushing 30 may have a generally square outer surface, a generally circular inner surface, and include a flange (FIG. 9). The outer bushing 30 may be slid into a coaxial aperture 36 located in the winch frame 16 (FIGS. 6 and 8). The frame aperture 36 may be arranged to match the generally square outer surface of the outer bushing 30 so that the outer bushing 30 may not rotate when located in the frame aperture 36. The outer bushing 30 may be fabricated from a polymeric material such as nylon.

The inner bushing 32 may have a generally circular outer surface and include a flange (FIG. 9). The inner bushing 32 may be positioned within the outer bushing 30, where the circular inner surface of the outer bushing 30 may match the circular outer surface of the inner bushing 32. The inner surface of the inner bushing 32 may also have a hexagonal shape to accommodate the hexagonal shape of the drive shaft 28. The inner bushing 32 may be fabricated from an oil impregnated self-lubricating bronze material. Such an arrangement may provide for an extended service life.

The outer and inner bearings 30, 32 may support the drive shaft 28 on one side within the winch frame 16 (FIG. 9). The combination of the bearings 30, 32 may functionally transform the hexagonal outer surface of the drive shaft 28 to a circular outer surface to facilitate smooth and efficient rotation of the drive shaft 28 within the aperture 36 of the frame 16. Such an arrangement may provide for a drive system that functions smoothly even when encountering irregularities in drum gears 38 due to manufacturing and assembly processes such as stamping and welding.

The three drive gears 34 positioned on the drive shaft 28 may be arranged to drive the winch drum 18 and to facilitate the locking of the drum 18 (FIGS. 6 and 9). The drive gears 34 may be positioned within the frame 16 and between the bushings 30, 32 and the gearbox 76. The two outer drive gears 34*a*, 34*c* may engage the drum 18 to drive the drum 18. The drum 18 may be fabricated with a pair of drum gears 38 (FIGS. 6 and 9).

Figure 10A:
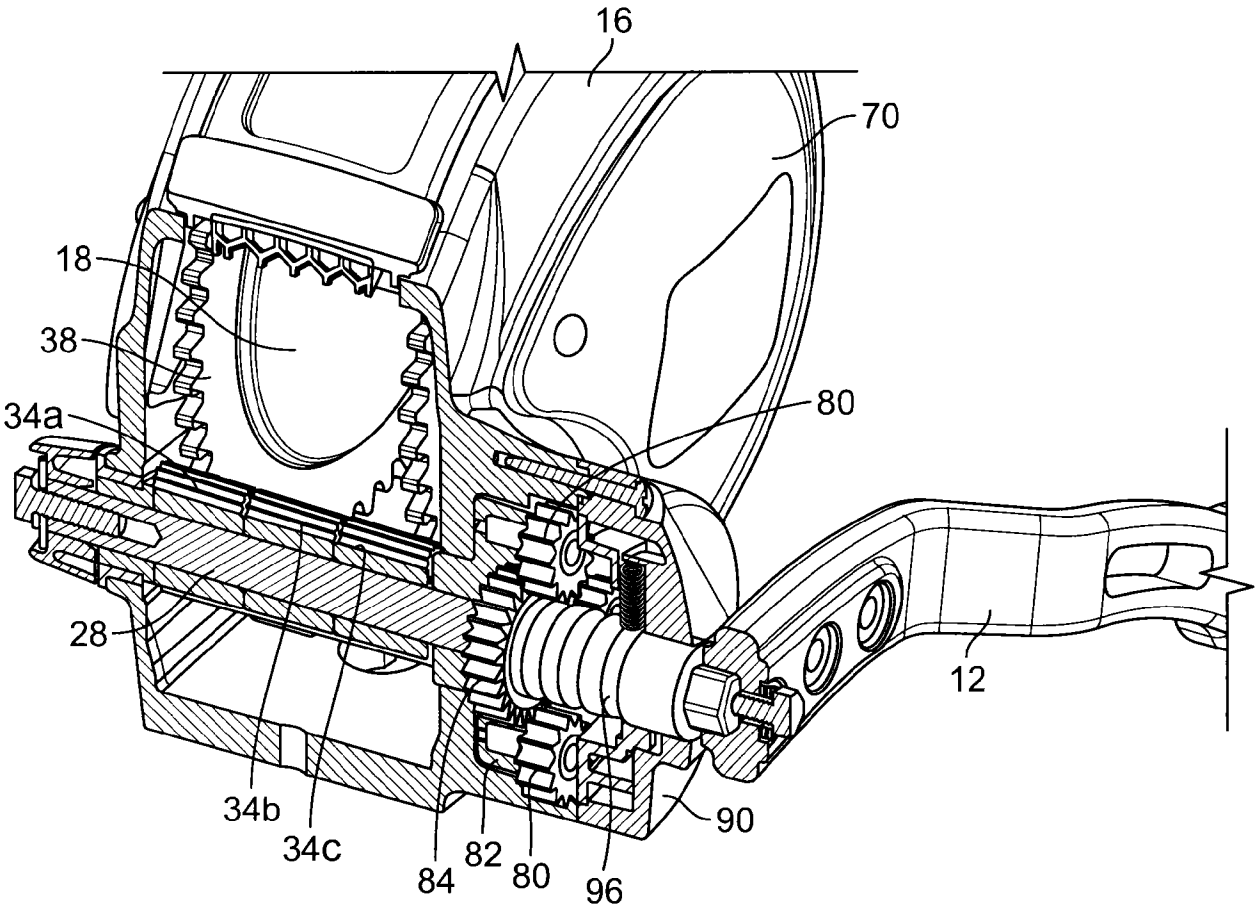
FIGS. 10A-10C illustrate perspective views of a gearbox of a two speed winch assembly in high, low and neutral positions.

The two outer drive gears 34*a*, 34*c* may engage the pair of drum gears 38 to drive the drum 18 with an even and balanced force (FIGS. 6 and 10A). The middle drive gear 34*b* may function as a ratchet type plunger engagement device to control the locking and release of forward and reverse rotational motion of the winch drum 18. These gears 34 may be slip fit over the drive shaft 28 and function or operate independent of each other.

The winch drum 18 may include a pair of drum gears 38 symmetrically positioned at the sides of the drum 18. The drum 18 may be manufactured or fabricated so that the drum gears 38 may be integrally formed with the drum 18, i.e., the drum gears 38 and the drum 18 are one singular, unitary component. Such fabrication may eliminate the need for welding, riveting, or otherwise securing gears to a drum.

The symmetric positioning of the drum gears 38 with respect to the drum 18, along with the dual drive gears 34 of the drive system may encourage even loading and balancing of forces when the drum 18 is wound and unwound. Such even loading may reduce or eliminate side load conditions that may damage the drum 18. Such balanced forces may increase the service life of the drum 18 and the drum gears 38.

The drum 18, along with a rear cover 22, may guide the strap such that the strap experiences less wear and tear and is protected against grease from the gears and other contaminants. The drum 18 may include a sump 60 protruding from the inner side of each drum gear 38 (FIGS. 2, 3, 6 and 9). The sump 60 may extend from the inner surface of the drum gears 38 so as to encourage a retracting strap towards the center of the drum 18 and away from the teeth of the drum gears 38.

Such an arrangement may result in a reduction or elimination of instances when the strap engages or becomes entangled with the drum gears 38, which would cause damage and other wear, along with potentially contaminating the strap with grease. In addition, the sumped sides 60 may also encourage a strap guide 62 to nest inside the rear cover 22 further protecting the strap from wear and or contamination.

The drive shaft 28 may be fabricated as a one-piece steel drive shaft with apertures drilled and tapped on each end (FIG. 9). A retaining cap 40 may be engaged with an end of the drive shaft 28 to hold the drive shaft 28 within the aperture 36 of the frame 16 (FIGS. 1, 6, 9, 11, 16 and 18). Stainless steel washers 42, such as shim washers, may also be used to prevent wear between bushing 30, 32 surfaces (FIG. 9).

The handle 12 of the two speed winch assembly 10 may be mounted on any appropriate side of the frame 16, such as the left hand side. If utilizing a single speed winch, the handle 12 may be mounted on either side of the winch, such as the left or right hand side. U.S. patent application Ser. No. 12/558,252, which is herein incorporated by reference in its entirety, describes in further detail such a handle, its mode(s) of operation, and the operation of a single speed winch.

Figure 12A:
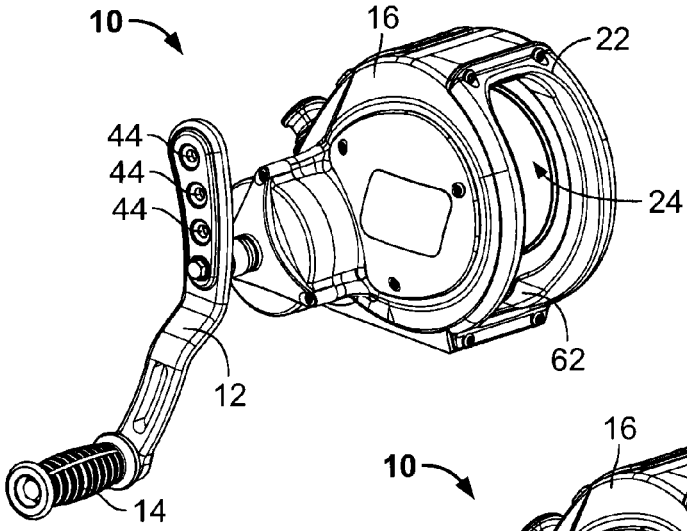
FIGS. 12A-12C illustrate perspective views of a handle attached to a two speed winch assembly at varying positions.
Figure 12B:
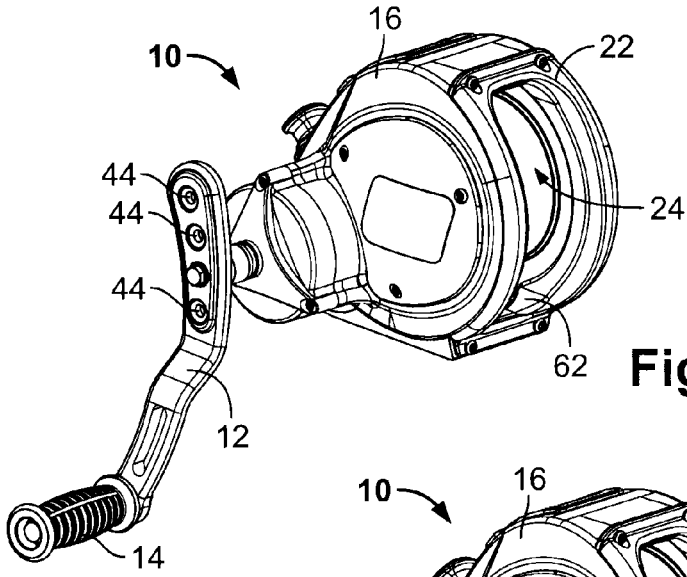
Figure 12C:
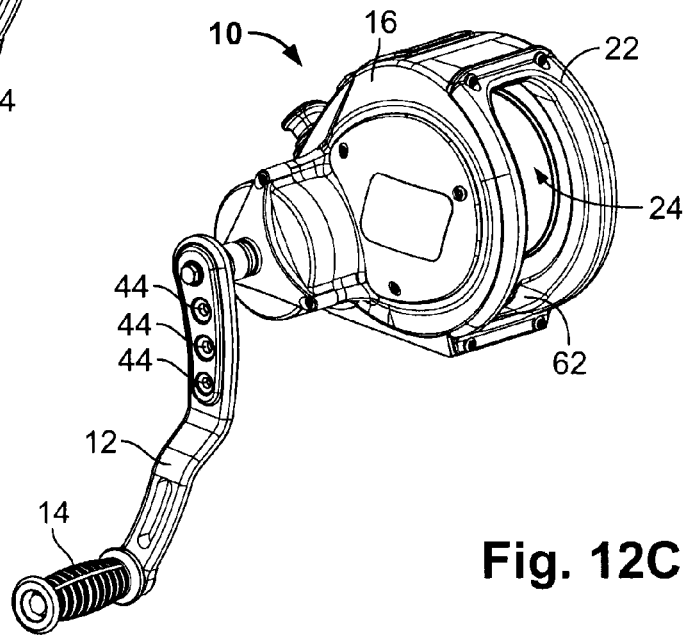

The handle 12 may be mounted on an end of the drive shaft 28 to permit left hand manual rotation of the handle 12 in a variety of length positions (FIGS. 12A-12C). For example, the handle 12 may be fitted with a series of mounting locations or apertures 44 located along the handle 12 (FIGS. 12A-12C and 15). The handle 12 may be adjustable from approximately 6-9 inches based on which aperture 44 the handle 12 is secured to.

The handle 12 may thereby be positioned at a number of different positions via the adjustment apertures 44 to either shorten or lengthen the lever arm portion of the handle 12. The handle 12 may be assembled in a variety of positions depending on need and circumstances. Cap screws, washers, etc., as shown in the figures, may secure the handle 12 and retaining cap 40 to the winch assembly 10. All components may be assembled with a toleranced slip fit and may be universal right to left for assembly purposes.

The two speed gearbox 76 may be of any appropriate shape, size, type or configuration, such as a planetary gearbox (FIGS. 6 and 9-10C). The gearbox 76 may include an internal ring gear 78, planetary gears 80, a planetary gear carrier 82 and a sun gear 84 (FIGS. 6 and 9-10C). Epicyclic gearing or planetary gearing is a gear system that consists of one or more outer gears, or planet gears 80, that revolve about a central, or sun gear 84. Typically, the planetary gears 80 may be mounted on a movable arm or gear carrier 82 that itself may rotate relative to the sun gear 84 (FIGS. 6 and 9-10C). Epicyclic gearing systems may also incorporate the use of an annulus or outer ring gear 78, which may mesh with the planet gears 80.

Epicyclic gearing may be used to increase output speed. For example, the two speed planetary gearbox may increase the capacity of the winch assembly 10 up to 3200 lbs and may also provide a neutral for reeling out the strap. The planetary gearbox body 74 may be cast into the side of the winch frame 16. The planetary gearbox 76 may reduce from 5:1 in high gear to 15:1 in low gear, thereby reducing the handle 12 effort required.

The planetary gear carrier 82 may be driven by an input torque. The sun gear 84 may provide the output torque, while the ring gear 78 may be fixed. It is to be understood that the gears 78, 80, 82, 84 may be of any appropriate shape, size, type or configuration and should not be limited to that shown or described herein. For example, the sun gear 84 may be a pinion gear.

Figure 10B:
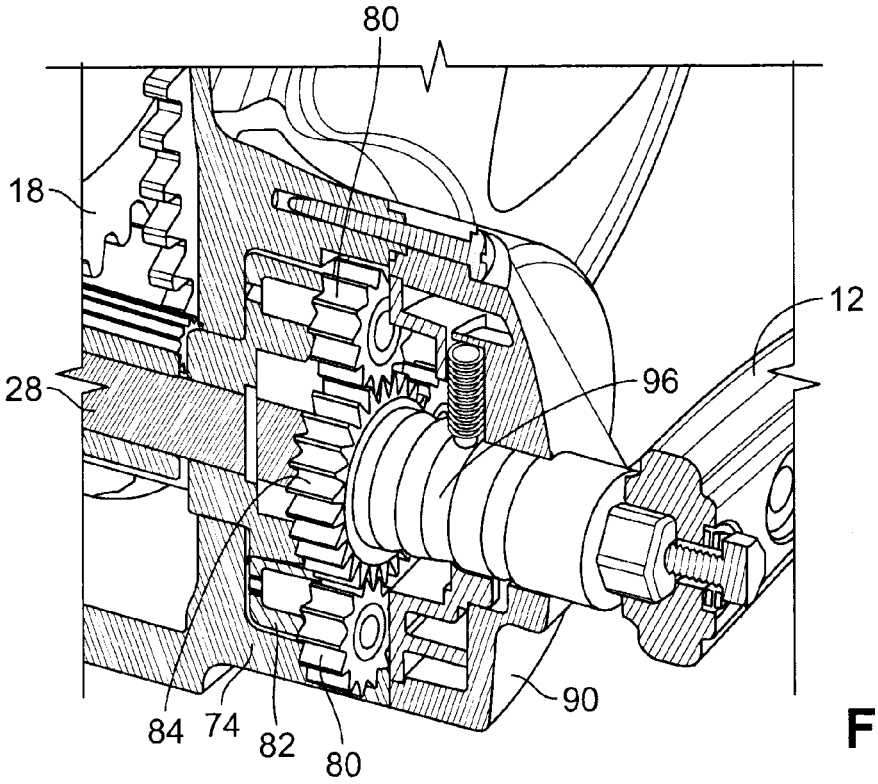
Figure 10C:
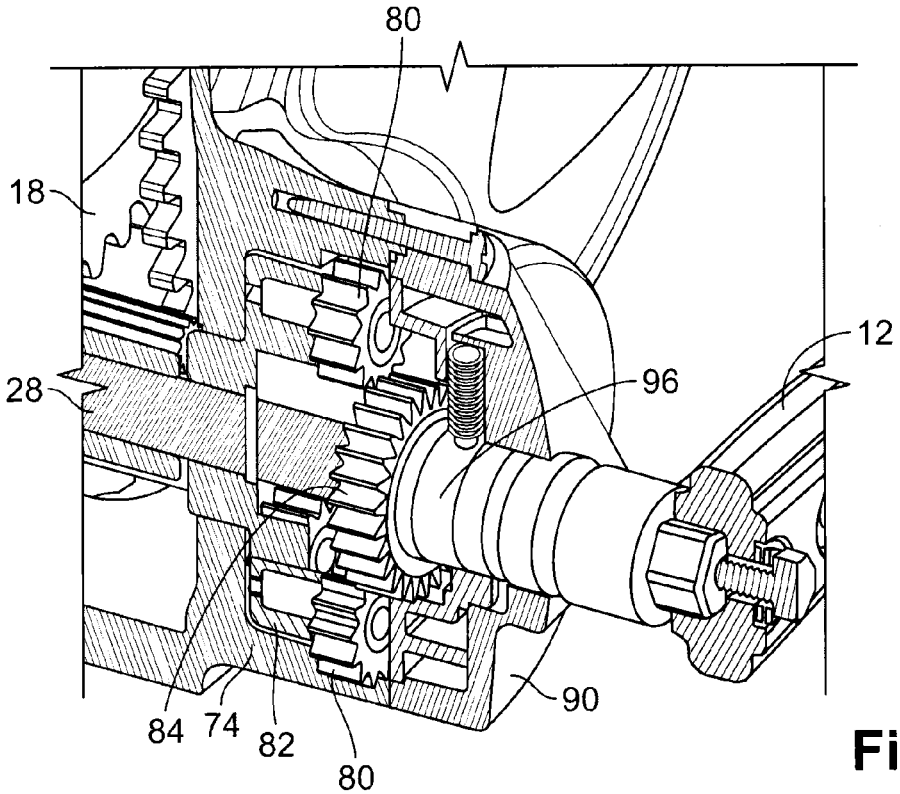
Figure 11:
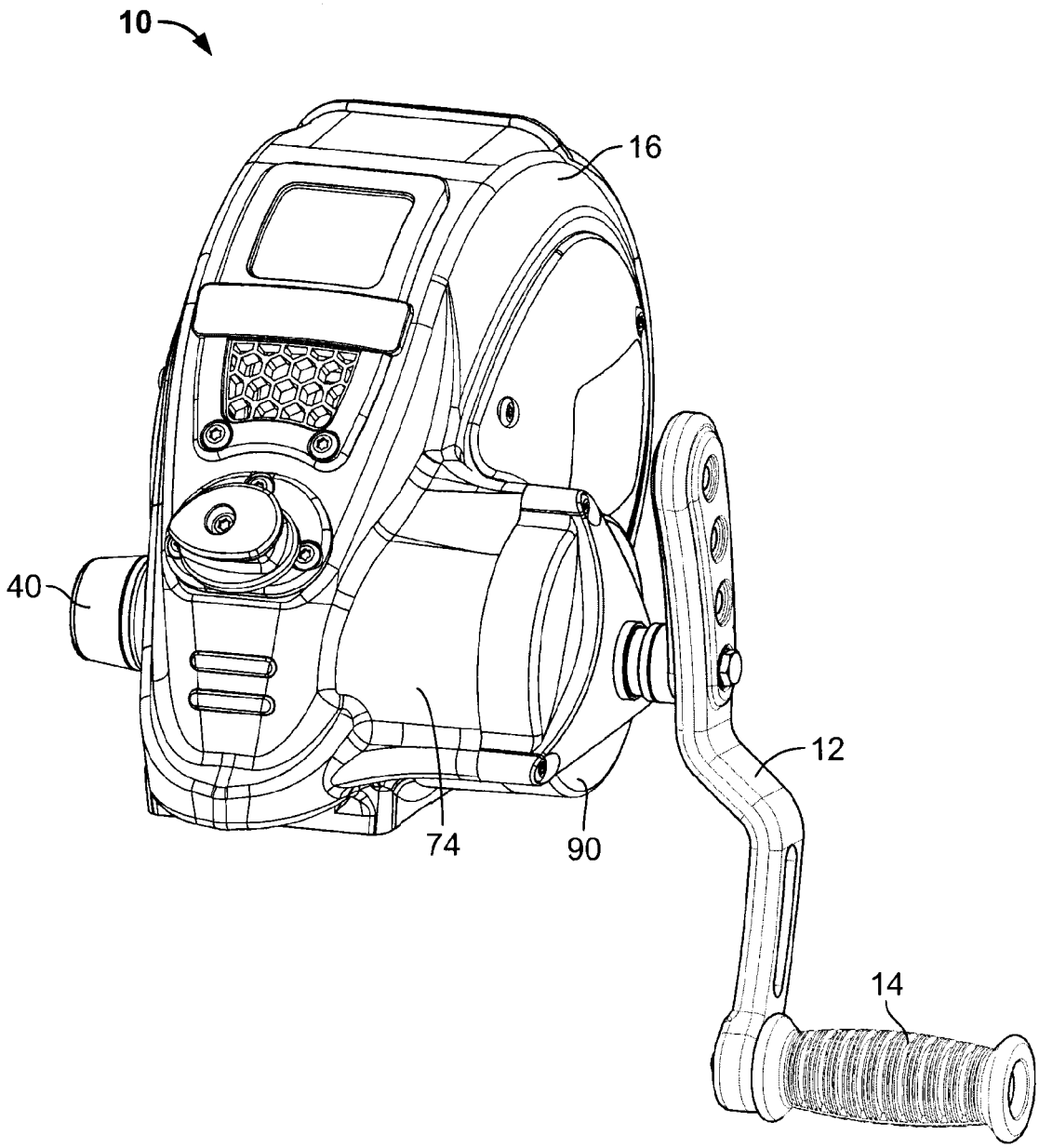
FIG. 11 illustrates a perspective view of the two speed winch assembly.

The sun gear 84 may include an extended portion that may include detents or grooves 96 (FIGS. 9-10C). The sun gear 84 may move from the left to the right to change the gearing of the gearbox 76. The grooves 96 may be of any appropriate shape or size and be located at any appropriate position on the sun gear 84. The grooves 96 may aid in maintaining the winch assembly 10 in the desired position, high, low or neutral. The sun gear 84 may provide the low gear, whereby the planetary gear carrier 82 is not engaged at all.

The gearbox 76 may be housed within a gearbox mounting area 74 that may be located within the frame 16 (FIGS. 1, 6, 9-10C, 16 and 18). The gearbox mounting area 74 may include the internal ring gear 78. The internal ring gear 78 may be integrally formed within the mounting area 74 and frame 16 of the winch assembly 10 (FIG. 9). For example, the internal ring gear 78 and its associated teeth may be integrally cast into the frame 16 of the winch assembly 10. As an alternative, the ring gear 78 may be machined into the frame 16.

The winch assembly 10 may conform to the SAE J1853 standard for marine trailer winches. For example, twice the rated tension load may be applied through a first layer of wire rope on the marine winch assembly 10, whereby the winch assembly 10 must not release the load and still be able to operate after this overload test. In addition, three times the rated tension load may be applied through the first layer of wire rope on the marine winch assembly 10, whereby the winch assembly 10 must not release the load.

The winch assembly 10 may be mounted by bolting or welding in such a manner that three times the rated straight line pull of the winch assembly 10 can be applied without failure of the winch assembly 10 attachment. In a non-limiting example, the winch assembly 10 may be rated up to 3,200 lbs, whereby 9,600 lbs. may be achieved three times without releasing the load. Moreover, the winch assembly 10 may have a capacity of up to 3200 lbs. in low gear and a capacity of up to 2000 lbs. in high gear.

The gearbox 76 may also utilize a gearbox cover 90 (FIGS. 1, 6, 8-11, 14A, 14B and 16-18). The gearbox cover 90 may be of any appropriate shape or size, such as a generally cylindrical shape that may only be open on one end. The cover 90 may be secured to the gearbox mounting area 74 of the frame 16 by any appropriate means, such as by fasteners (FIG. 9). The fasteners may be of any appropriate shape, size or type, such as nuts, bolts, and washers.

Figure 1:
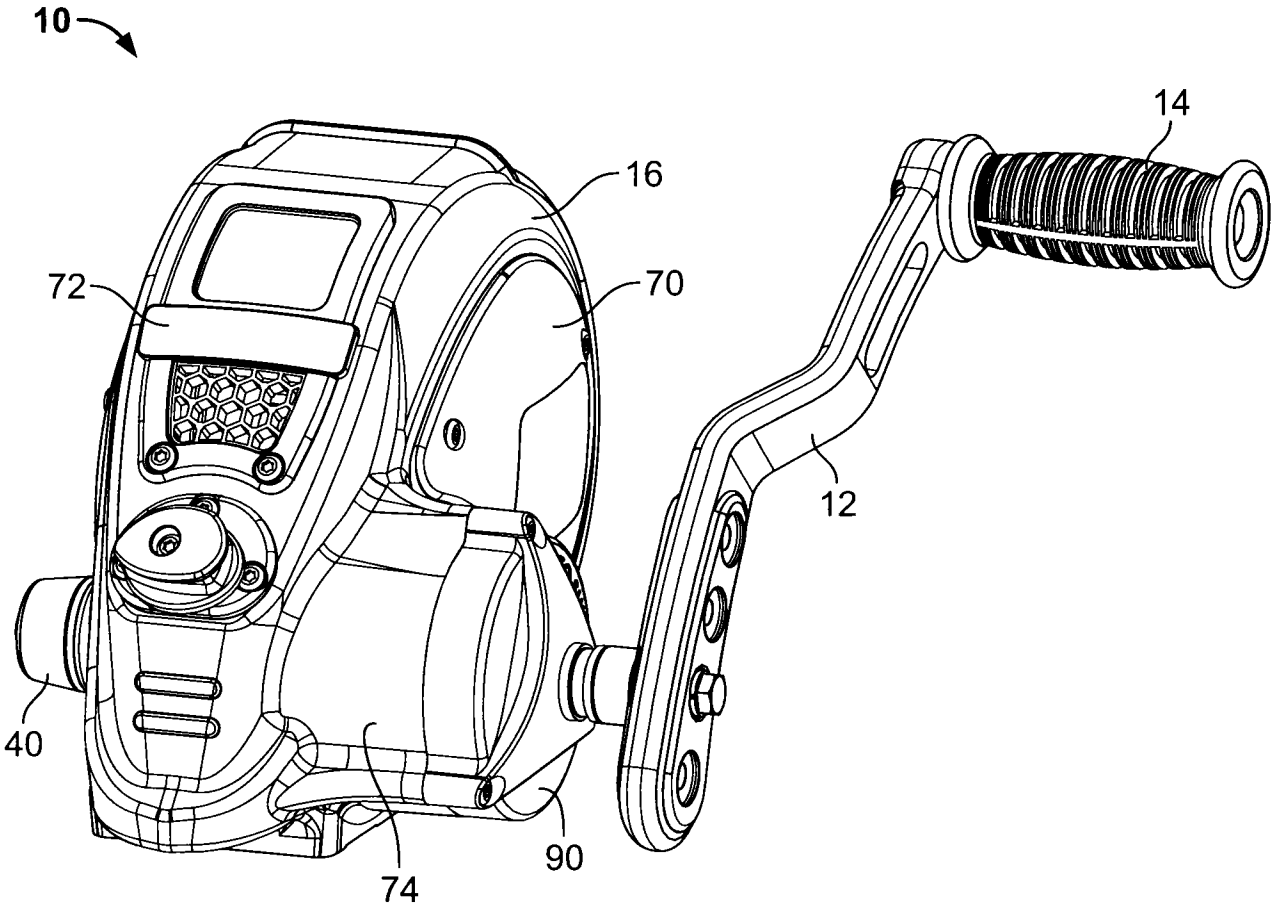
FIG. 1 illustrates a perspective view of a two speed winch assembly.
Figure 3:
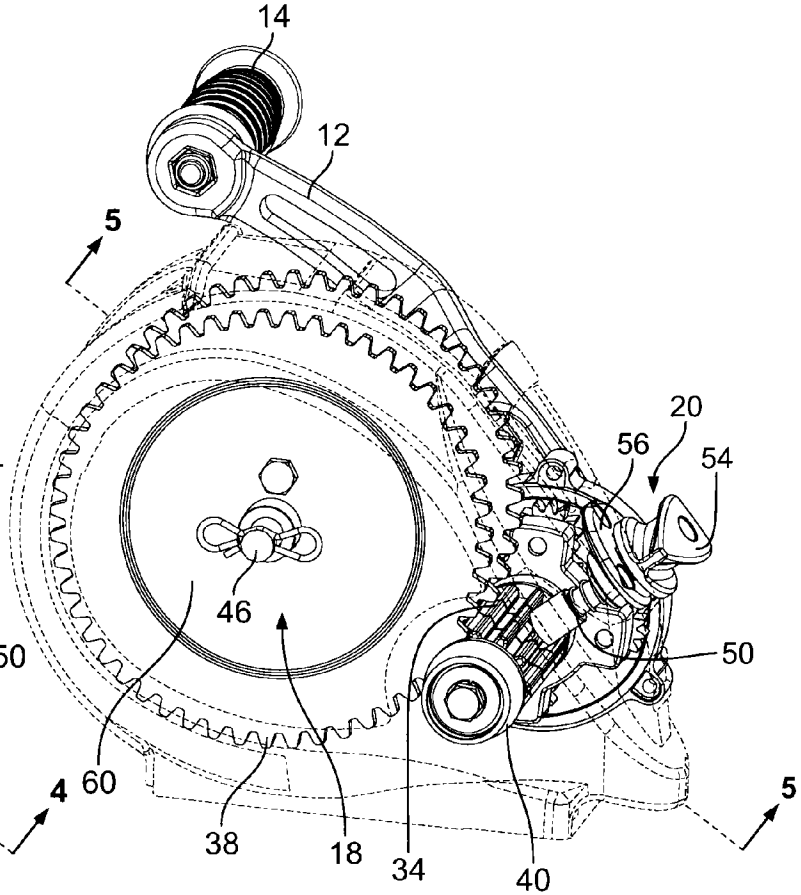
FIG. 3 illustrates a perspective view of internal mechanisms of the winch assembly of FIG. 1 where a ratchet and pawl system is engaged.

Typical ratchet pawl systems may only be located on one side or the other of a winch, thereby limiting access if the operator is on the opposite side. Moreover, most ratchet pawl systems are made of several loose components that may be cumbersome to assemble and replace if needed. The ratchet and pawl system 20 of the winch assembly 10 may be located in the middle of the winch assembly 10, thereby making it easily accessible from either side (FIGS. 1, 6 and 9).

Figure 13A:
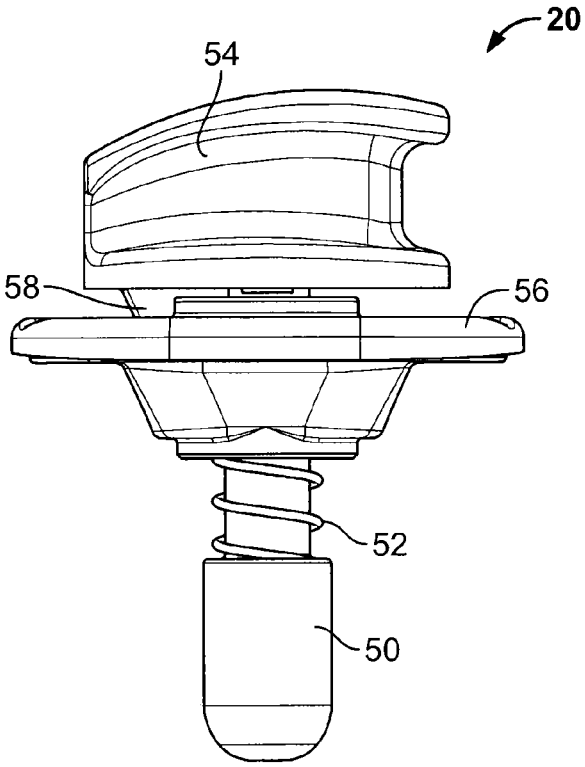
FIGS. 13A-13C illustrate views of a ratchet system for a two speed winch assembly.
Figure 13B:
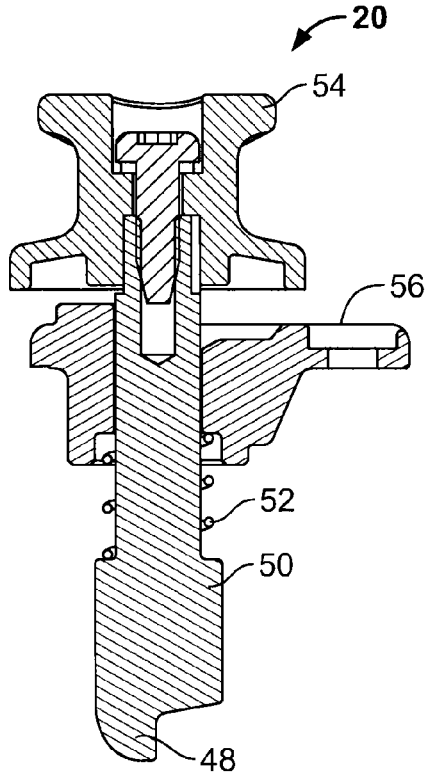
Figure 13C:
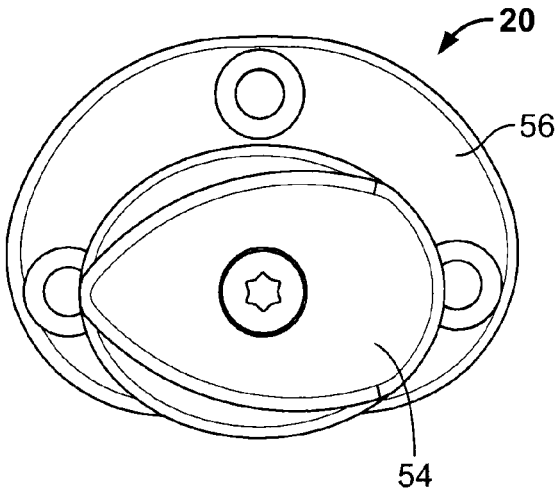

The ratchet and pawl system 20 may be mounted in the center of a symmetrical winch frame 16 as a separate and self-contained one piece assembly (FIGS. 13A-13C). Such positioning makes the ratchet and pawl system 20 accessible from either side of the winch assembly 10. For example, the ratchet and pawl system 20 may be positioned generally through the centerline of a symmetrical winch assembly 10 and may be a separate, self-contained assembly.

The winch frame 16 may be arranged such that the ratchet and pawl system 20 may be housed within the frame 16 to prevent unnecessary damage to components (FIGS. 2-5). Such positioning also allows for a shorter pin 50 because of its proximity to the ratchet 34*b*. Such an arrangement places less bending forces on the pin 50 and increases the service life of the pin 50.

Figure 2:
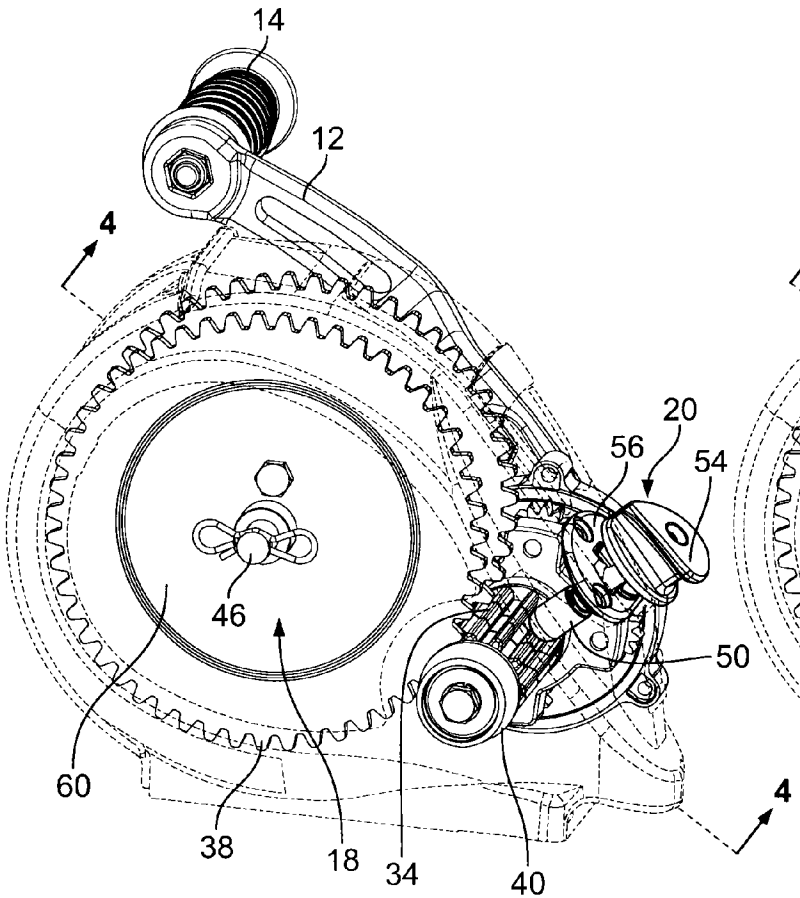
FIG. 2 illustrates a perspective view of internal mechanisms of the winch assembly of FIG. 1 where a ratchet and pawl system is disengaged.
Figure 4:
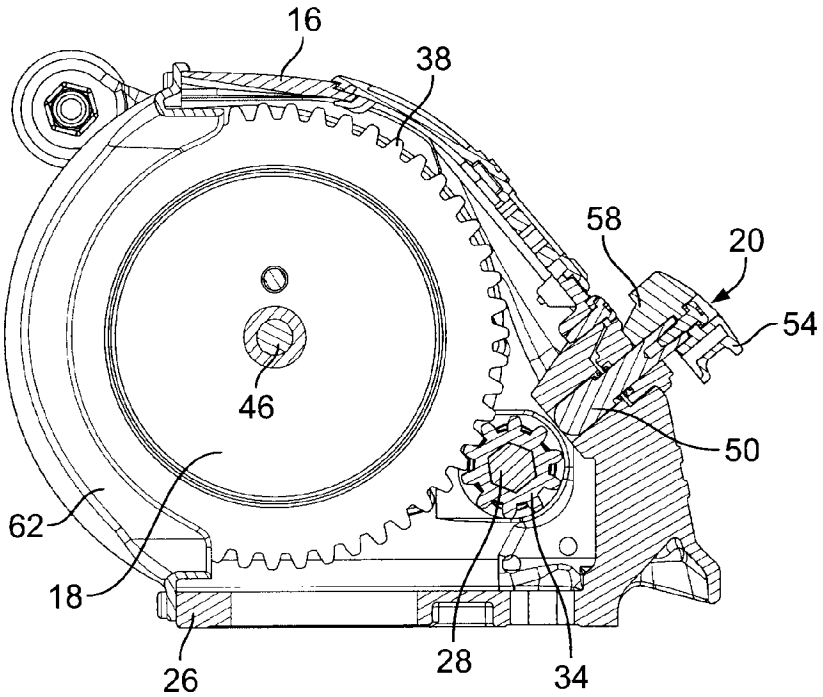
FIG. 4 illustrates a cross-sectional view of the winch assembly taken along line 4-4 of FIG. 2 where the ratchet and pawl system is disengaged.

The ratchet and pawl system 20 may also include a knob 54 and a bushing 56 (FIGS. 2, 3, 6 and 13A-13C). The knob 54 may be a simple pull and turn knob that may easily engage or disengage the ratchet and pawl system 20. The bushing 56 and knob 54 may be arranged such that features on the bushing 56 and knob 54 may provide for the knob 54 to be selectively positioned to engage a pin 50 with the middle drive gear or ratchet 34*b* (FIGS. 3 and 5) or be selectively positioned to disengage the pin 50 from the ratchet 34*b* (FIGS. 2 and 4).

The knob 54 may include a protrusion 58. The protrusion 58 may work with the mating insert bushing 56 that may seat the knob 54 in the neutral position, i.e., a position where the pin 50 is disengaged from the ratchet 34*b*. A partial turn of the knob 54 will ramp down into the desired engaged or disengaged position, and would allow the spring 52 to bias the pawl 50 into contact and engagement with the ratchet 34*b*. The knob 54 may also self align itself into place easily from the neutral position or if only turned partially (FIGS. 4 and 13A).

The pin 50 may be in contact with a spring 52 and the knob 54. The pin 50 may pass through the bushing 56 such that the knob 54 may be accessible from the outside of the housing 16; however, the pin 50 may be located within the housing 16. The spring 52 may bias the pin 50 into engagement with the ratchet 34*b*. The system 20 may also be arranged to self align for easy placement of the pin 50 in contact with the middle drive gear or ratchet 34*b* when the knob 54 is only partially turned.

Figure 5:
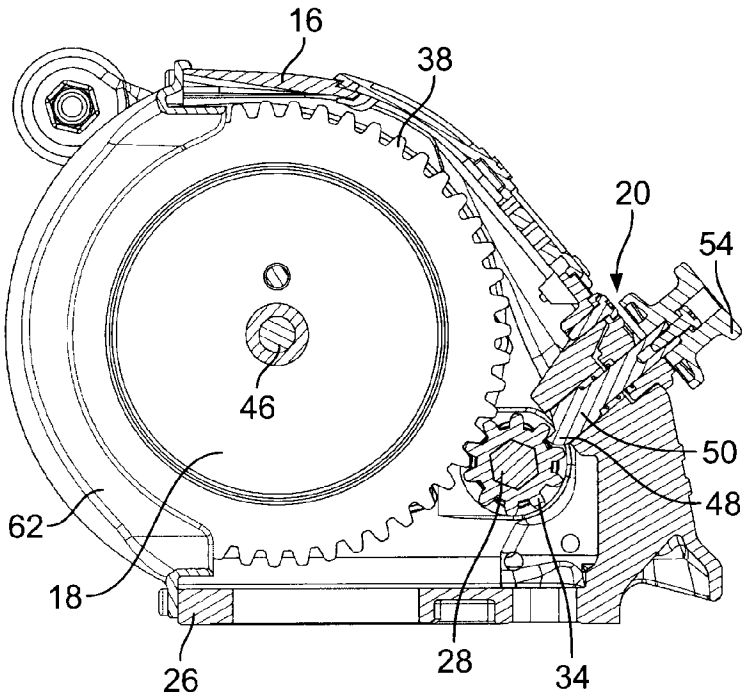
FIG. 5 illustrates a cross-sectional view of the winch assembly taken along line 5-5 of FIG. 3 where the ratchet and pawl system is engaged.

The pin 50 may include a lip 48 located at one end (FIGS. 5 and 13B). The lip 48 of the pin 50 may contact the middle drive gear or ratchet 34*b* and not the outer drive gears 34*a*, 34*c*, thereby reducing wear by spreading the contact points over several gears. The frame 16 enclosure of the ratchet and pawl system 20 may also enable strength characteristics allowing the pin 50 of the ratchet and pawl system 20 to be captured as close to the gear 34*b* as possible.

The winch assembly 10 may also include a rear cover 22 with an opening 24. The opening 24 may accommodate the winding and unwinding of a strap or cable from the winch drum 18, as the opening 24 may allow movement of the strap into and out of the winch assembly 10 (FIGS. 6, 9, 12A-12C and 18). The rear opening 24 may include material that is wrapped around the opening towards the drive gears 38 that may form a strap guide 62 (FIGS. 4-6, 9, 12A-12C, 14A and 18).

The strap guide 62 may extend into the housing 16 sufficiently to protect the strap against contact with the drum gears 38, specifically protection against contact with the teeth of the drum gears 38. Thus, further protecting the strap from damage, wear, grease and contaminants. As will be understood, the strap guide 62 may provide the strap with a smooth, clean port for entry and exit from the winch assembly 10.

The strap guide 62 may include mounts or protrusions 64 to protect the strap guide 62 from contacting the teeth of the drum gears 38. The protrusions 64 may run on the smooth portion of the drum gears 38 and avoid contact with the gear teeth. In addition, the strap guides 62 may enclose the potentially sharp edges of the winch frame 16, further protecting the strap and uses of the winch assembly 10 from potential damage and injury.

The winch assembly 10 may be arranged so that it may be secured to a towing trailer or a winch stand without accessing the inside of the winch housing 16. Such an arrangement provides for easy and quick installation of a winch assembly 10 without concern for opening or accessing the housing 16, unwinding the strap, etc. The winch assembly 10 may be installed using fasteners, such as nuts, bolts and washers, from the bottom of the winch assembly 10.

Figure 7:
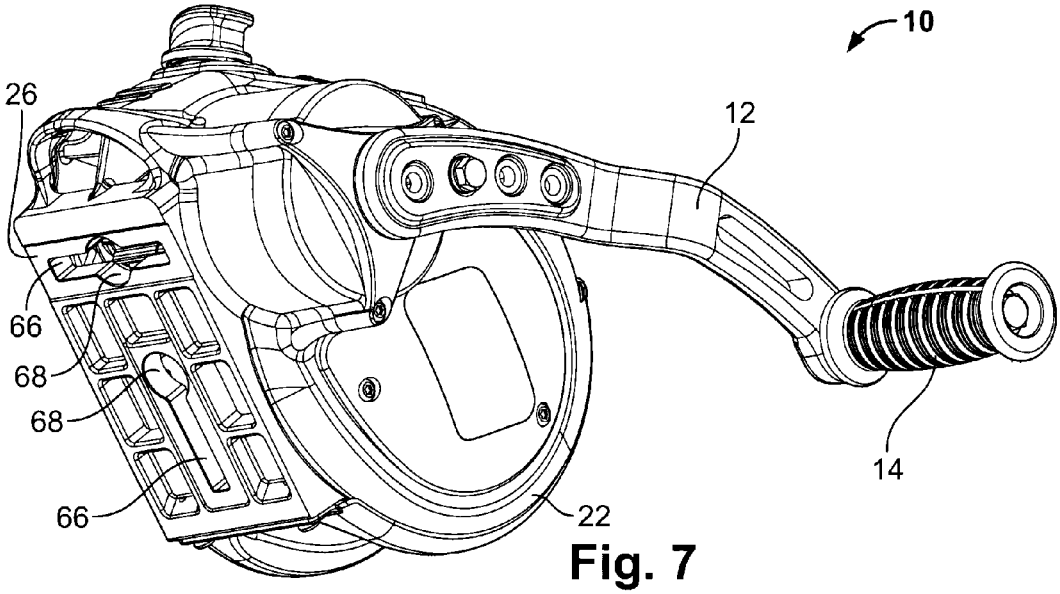
FIG. 7 illustrates an underside perspective view of a two speed winch assembly.
Figure 14B:
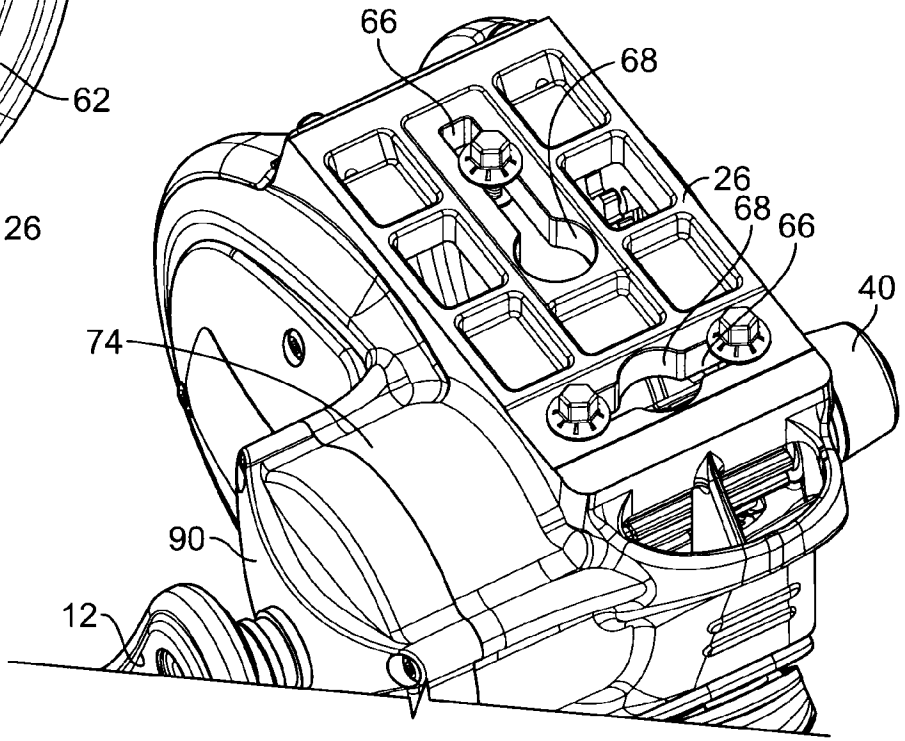
FIGS. 14A and 14B illustrate perspective views of a bottom plate of a two speed winch assembly.
Figure 14A:
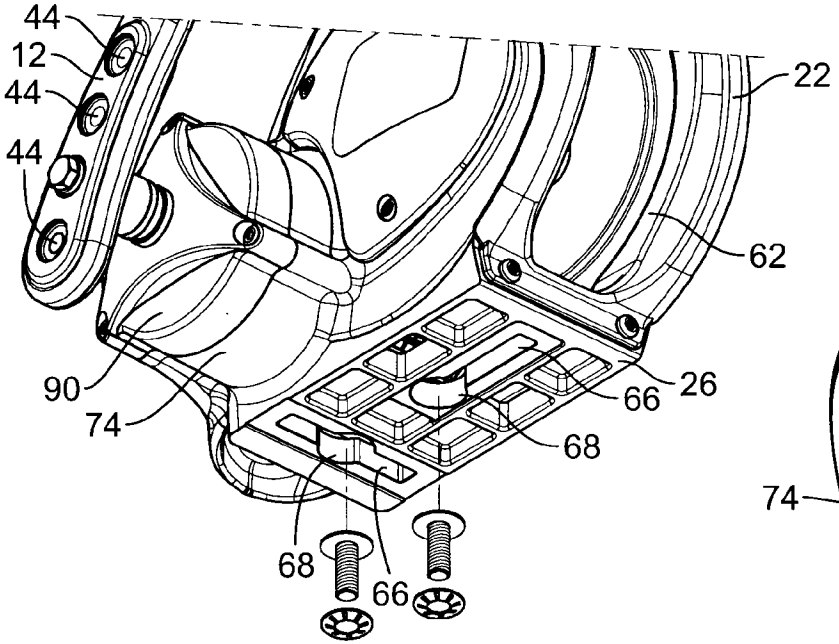
Figure 15:
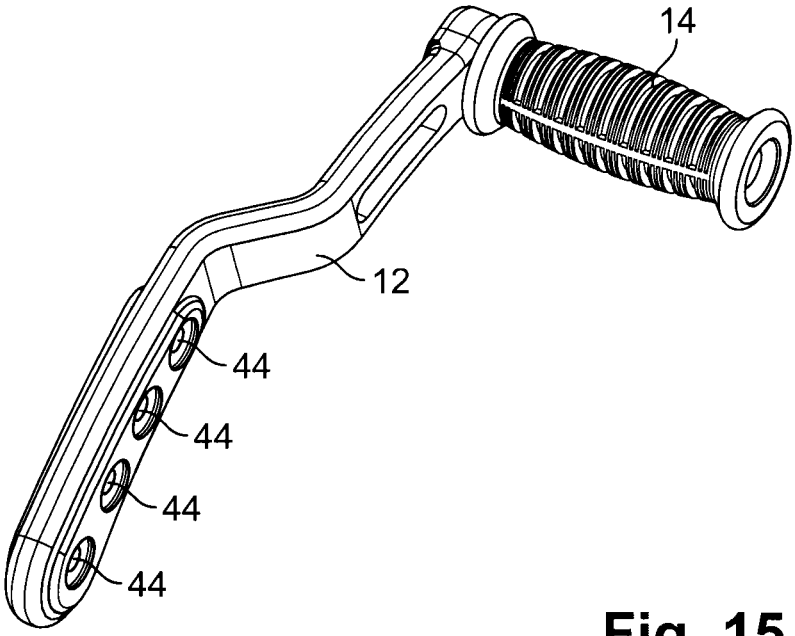
FIG. 15 illustrates a perspective view of an adjustable handle for a two speed winch assembly.
Figure 16:
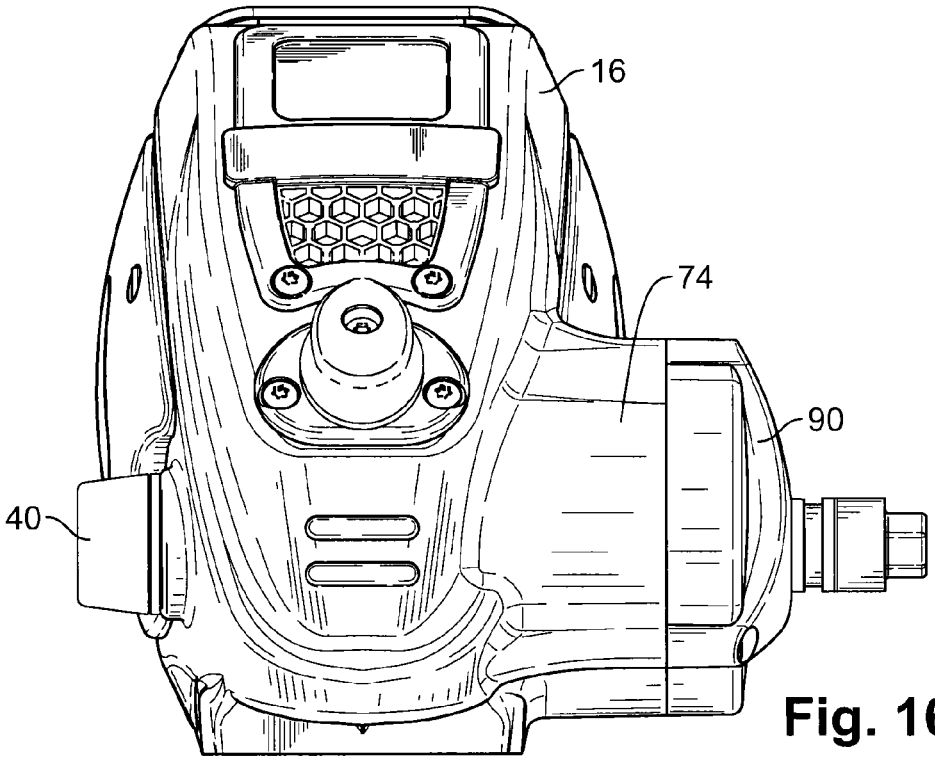
FIG. 16 illustrates a front view of a partial two speed winch assembly.
Figure 17:
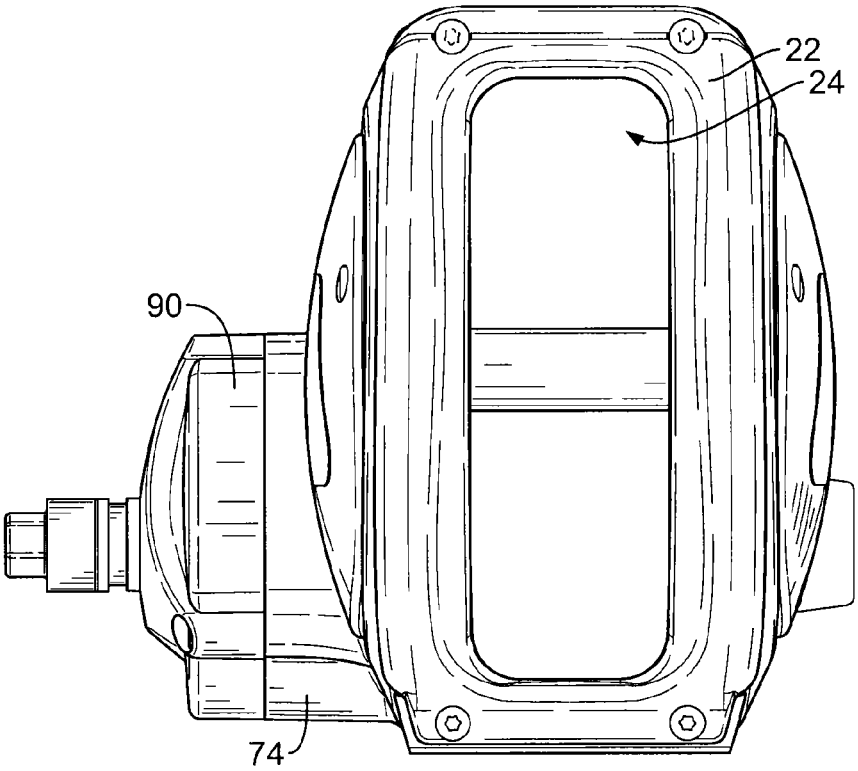
FIG. 17 illustrates a rear view of the partial winch assembly of FIG. 16.
Figure 18:
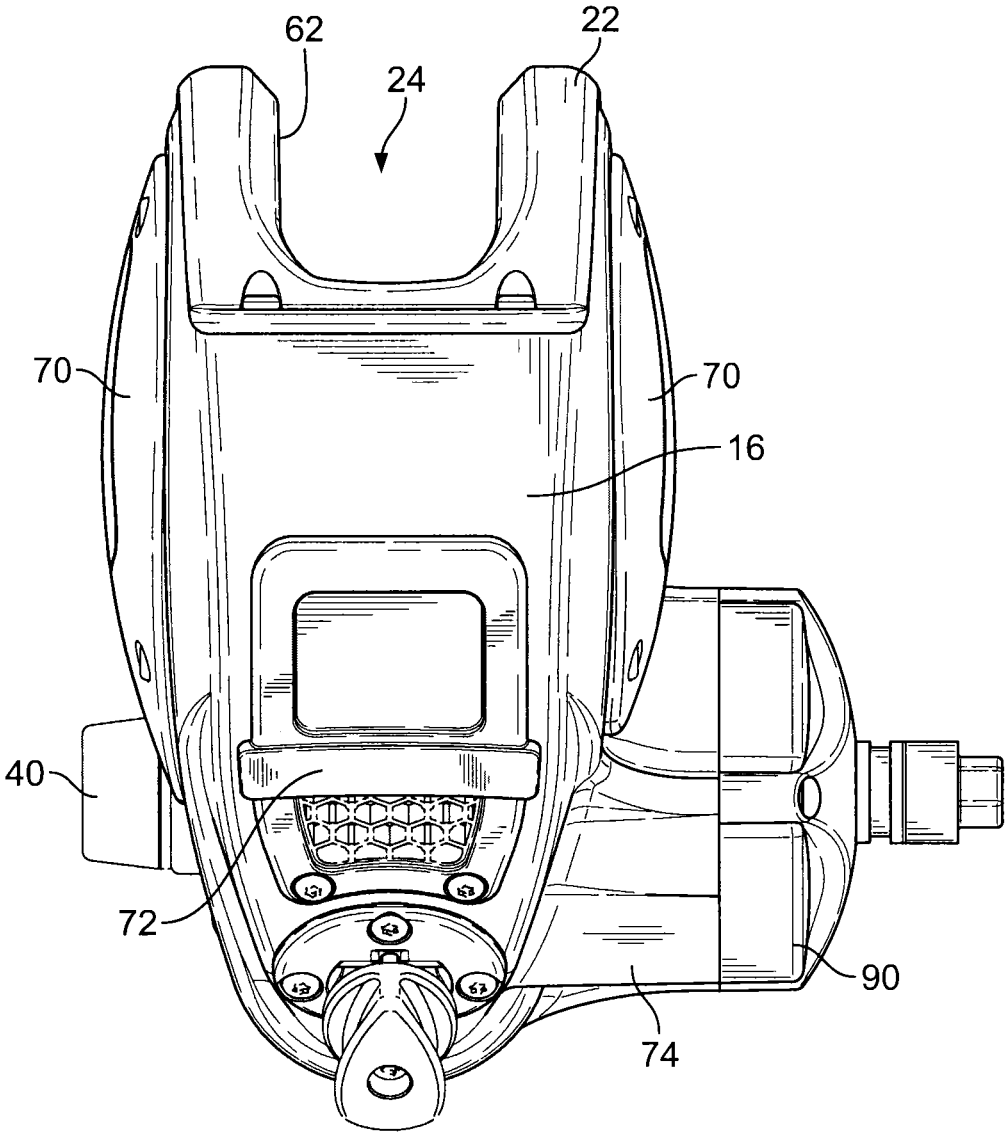
FIG. 18 illustrates a top view of the partial winch assembly of FIG. 16.

The winch assembly 10 may include an easy installation system (FIGS. 7, 14A and 14B). In a traditional mounting application, fasteners have to be installed in through the inside of the winch. This may be cumbersome due to several components being located on the inside of the winch. Making matters more difficult to access the mounting holes may be when a winch line is fully wound onto the drum. With this limited inside access, being able to hold down the head of the bolts is sometimes a problem when trying to tighten the nuts from the bottom side. Occasionally, parts of the winch may need to be disassembled to complete the installation.

The easy installation system may include cast in features on the base 26 of the winch assembly 10. These cast in features may be used with carriage bolts and keeper washers. The bottom plate 26 of the frame 16 may include a series of grooves 66 and apertures 68 (FIGS. 7, 14A and 14B). Die casting the winch assembly 10 allows for the grooves 66 and apertures 68 of the base plate 26 to be incorporated into the frame 16. A consumer may insert bolts from the bottom of the winch assembly 10, place the winch assembly 10 onto a winch or mounting stand, attach and tighten nuts from the bottom side of the winch assembly 10. This arrangement may only require a single wrench to tighten the winch assembly 10 down.

The series of grooves 66 and apertures 68 may allow the bolts to be held in place until the nuts can be threaded onto the bolts (FIGS. 7, 14A and 14B). This is accomplished by the heads of bolts fitting through apertures 68 and allowing for the shaft of the bolt to slide along the grooves 66. The grooves 66 along with the square necks of fasteners, such as carriage bolts, may prevent these bolts from spinning while tightening. Thus, simplifying installation and requiring less tools.

Although the preferred embodiment of the present invention has been illustrated in the accompanying drawings and described in the foregoing detailed description, it is to be understood that the present invention is not to be limited to just the preferred embodiment disclosed, but that the invention described herein is capable of numerous rearrangements, modifications and substitutions without departing from the scope of the claims hereafter.

Having thus described the invention, the following is claimed:

1. A two speed winch assembly comprising:
- a frame having a gearbox mounting area comprising an internal ring gear monolithically formed with said frame;
- a drive system housed within said frame, said drive system comprising:
  - a winch drum;
  - at least one drive gear capable of engagement with said winch drum;
  - a planetary gearbox operable with said internal ring gear; and
- an adjustable handle for operating said drive system, wherein said handle is axially moveable relative to said frame.

2. The winch assembly of claim 1, wherein said frame is fabricated as monolithic cast unit from die cast aluminum.

3. The winch assembly of claim 1, wherein movement of said handle switches said drive system from a high to a low position.

4. The winch assembly of claim 3, wherein said winch drum is driven by a manual rotation of said handle.

5. The winch assembly of claim 1 further comprising a pin located through said frame, wherein said pin is capable of engagement with said at least one drive gear.

6. The winch assembly of claim 1, wherein the planetary gear box comprises:
- a sun gear, a gear carrier and at least one planetary gear;
- a detent mechanism to adjust said winch from high and low gears; and
- wherein said handle is axially moveable relative to said frame to engage and disengage said at least one planetary gear to and from said sun gear.

7. The winch assembly of claim 6, wherein the detent inhibits movement of said handle.

8. The winch assembly of claim 1, wherein said handle is attached with said drive system at a pivot axis whereby said handle is axially moveable relative to said frame along said pivot axis.

9. A two speed winch assembly comprising:
- a frame including a gearbox mounting area comprising an internal ring gear housed within said frame;
- a drive system housed within said frame, said drive system comprising:
  - a winch drum;
  - a drive shaft having two ends;
  - at least one drive gear located on said drive shaft and capable of engagement with said winch drum;
  - a planetary gearbox operable with said internal ring gear, said planetary gearbox comprising:
    - a sun gear, a gear carrier and at least one planetary gear;
    - a detent mechanism to adjust said winch from high or low gear; and
- an adjustable handle for operating said winch, wherein said handle is moveable relative to said frame to engage and disengage said at least one planetary gear with and from said sun gear.

10. The winch assembly of claim 9, wherein said handle operates said winch between the high or low gear.

11. The winch assembly of claim 10, wherein said sun gear is engaged with said at least one planetary gear during low gear.

12. The winch assembly of claim 10, wherein said sun gear is engaged with said gear carrier during high gear.

13. The winch assembly of claim 9, wherein said detent mechanism inhibits movement of said handle.

14. The winch assembly of claim 9 further comprising a ratchet and pawl system located in said frame and capable of engagement with said drive system, said ratchet and pawl system comprising:

a pawl and spring located through a bushing, wherein said pawl is capable of engagement with said at least one drive gear; and a knob located at an end of said pawl and capable of rotating said pawl into and out of engagement with said at least one drive gear.

15. The winch assembly of claim 14, wherein said bushing and knob provide for said knob to be selectively positioned to engage said pawl with said at least one drive gear or be selectively positioned to disengage said pawl from said at least one drive gear.

16. The winch assembly of claim 9 further comprising a strap guide located at a rear opening of said frame.

17. The winch assembly of claim 16, wherein said strap guide extends into said frame thereby protecting a strap against contact with said winch drum.

18. A winch assembly comprising:

a frame having an internal ring gear, a front face and two sides laterally disposed from each other;

a winch drum positioned within said frame;

a drive shaft;

at least one drive gear positioned on the drive shaft, the at least one drive gear configured to engage said winch drum;

a planetary gearbox operable with said internal ring gear; and a pin connected with said frame, wherein said pin is movable to engage said at least one drive gear to limit rotation of said drive shaft, wherein said pin is located on said front face and approximately centered between said two sides of said frame.

19. The winch assembly of claim 18, wherein said internal ring gear is integrally formed with said frame.

20. The winch assembly of claim 18, further comprising a handle operatively connected with said drive shaft to pivot said drive shaft about an axis, wherein said handle is axially moveable along said axis and relative to said frame to adjust said winch between high and low gears.

* * * * *